US006003326A

United States Patent [19]

Hensley

[11] Patent Number: 6,003,326

[45] Date of Patent: Dec. 21, 1999

[54] FOGGING VENDING MACHINE

[75] Inventor: Mark Hensley, Encinitas, Calif.

[73] Assignee: Cool Zone, Inc., San Diego, Calif.

[21] Appl. No.: 09/128,621

[22] Filed: Aug. 4, 1998

Related U.S. Application Data

[60] Provisional application No. 60/055,211, Aug. 4, 1997.

[51] Int. Cl.[6] ..... A47F 3/04

[52] U.S. Cl. ..... 62/247; 62/314; 261/78.2; 261/DIG. 14

[58] Field of Search ..... 62/247, 314; 261/78.2, 261/DIG. 14

[56] References Cited

U.S. PATENT DOCUMENTS 5,193,354 3/1993 Kleinberger et al. ..... 62/247

5,240,648 8/1993 Gill et al. ..... 261/78.2

5,785,204 7/1998 Thompson et al. ..... 221/24

FOREIGN PATENT DOCUMENTS 2258299 2/1993 United Kingdom ..... 62/247

*Primary Examiner*—William E. Tapolcal

*Attorney, Agent, or Firm*—Eckert Seamans Cherin & Mellott, LLC

[57] ABSTRACT

A fogging vending machine is provided. A vending machine has a housing, and a fogging means provides a fog consisting of a mist of atomized coolant which is partially evaporated and entrained in an air flow. At least one conduit is provided which has an inlet coupled to the fogging means and an outlet coupled to the vending machine housing to direct the fog away from the housing.

17 Claims, 2 Drawing Sheets

FOGGING VENDING MACHINE

CROSS REFERENCE TO RELATED APPLICATION

This application is a continuation of Provisional Application Ser. No. 60/055,211 filed on Aug. 4, 1997.

BACKGROUND OF THE INVENTION

1. Field of the Invention

The invention relates to air circulating and cooling devices, and in particular concerns an air circulating and cooling device with a misting or fogging means for establishing a cooled area surrounding a vending machine. The invention is integrated into the vending machine and provides a unique visual effect in which fog appears to flow from the vending machine front panel graphics.

2. Prior Art

There are well known techniques for providing relief from high temperature outdoor conditions generally involving one or more of air conditioning (cooling and/or dehumidification), application of water to the person for evaporative cooling, forced air circulation, shade from the sun and so forth. However, in a given situation it can be impractical or impossible to employ such remedies freely.

For example, air conditioning and dehumidification are wasteful of energy except in closed spaces; affected persons may not wish to drench themselves to cool off; shade may be unavailable at the desired location, etc. A typical air conditioning unit of sufficient capacity to provide meaningful relief in an open outdoor space would be prohibitively expensive.

SUMMARY OF THE INVENTION

It is an object of the invention to provide a cooling unit integrated into a vending machine, especially for use in open spaces that are relatively unconfined or outdoors, that cools comfortably and efficiently, at minimum expense.

It is a further object to provide a cooling unit integrated into a vending machine that provides a visually appealing fogging effect which is visible from large distances.

It is also an object to provide a cooling unit integrated into a vending machine that provides a visually appealing fog formed from extremely small droplets of a non-refrigerated coolant, especially plain water that flash evaporates thereby minimizing the condensation forming on individuals located in the vicinity of the vending machine.

It is another object of the invention to provide a cooling unit integrated into a vending machine that provides a visually appealing fog which is pushed away from the vending machine by a means for delivering forced air via one or more discharge ports formed in the vending machine.

It is another object of the invention to provide a cooling unit integrated into a vending machine that provides a visually appealing fog which is discharged through the vending machine front panel.

It is another object of the invention to provide a cooling unit integrated into a vending machine having front panel graphics that provides a visually appealing fog which is discharged through discharge ports formed in the vending machine front panel wherein the front panel graphics are specifically coordinated with the discharge ports thereby maximizing the visual effect.

These and other aspects and objects are provided according to the invention in an evaporative cooling unit in combination with a vending machine having structure defining vending machine having a housing and a front panel, a conduit with at least one outlet traversing the front panel of the vending machine, a fog box coupled to a fan or blower for forcing ambient air from an inlet in the fog box through the fog box and into the conduit to exhaust air through the conduit outlet, at least one atomizing spray nozzle located within the fog box for producing a fine mist of atomized coolant, a supply of coolant, a pump and a means for connecting the atomizing spray nozzle to the supply of coolant under pressure, and a drain line for returning any water collected in the fog box to the pump. The atomizing spray nozzle produces a fine mist of coolant which is discharged into the forced air flow to provide a fog or mist, the fog flows generally along the conduit and is discharged through the conduit outlet and the front panel of the vending machine, to provide a cool fog surrounding the vending machine and producing a pleasing visual effect.

One or more porous membranes can also be positioned to intersect the air flow such that air passes through the porous membrane and is thereby cooled. An atomizing nozzle can be arranged to soak the porous membrane with coolant for this purpose.

The front panel of the vending machine has graphics and the like and has a generally convex profile. Suitable front panels can be formed from molded plastic and the like. The conduit is arranged between the vending machine housing and the front panel and the front panel graphics are specifically designed (formed, molded, decorated . . . ) to coordinate with the discharge ports thereby maximizing the visual effect.

According to one embodiment, the front panel of the vending machine has graphics in the form of at least a portion of a soda bottle having an open top and the conduit outlet is positioned in the front panel approximately at the soda bottle top thereby providing for a visually appealing fog emanating from the top of the soda bottle.

The supply of coolant can be tap water provided by a public utility at standard pressure such as 45 psi coupled to the pump to provide a high pressure supply of water to the atomizing nozzle. Alternatively, pressurized water can be provided from a tank at atmospheric pressure through a pump. Likewise a booster pump can be provided to increase the pressure from a pressurized tank. Some of the fog discharged though the conduit outlet evaporates in the forced air to reduce the temperature of the discharge as compared to ambient temperature. More particularly, both the air and the remaining droplets in the stream have a temperature lower than their initial temperatures due to evaporative cooling.

A number of additional features and objects will be apparent in connection with the following discussion of preferred embodiments and examples.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

DETAILED DESCRIPTION OF THE PREFERRED EMBODIMENTS

Figure 1:
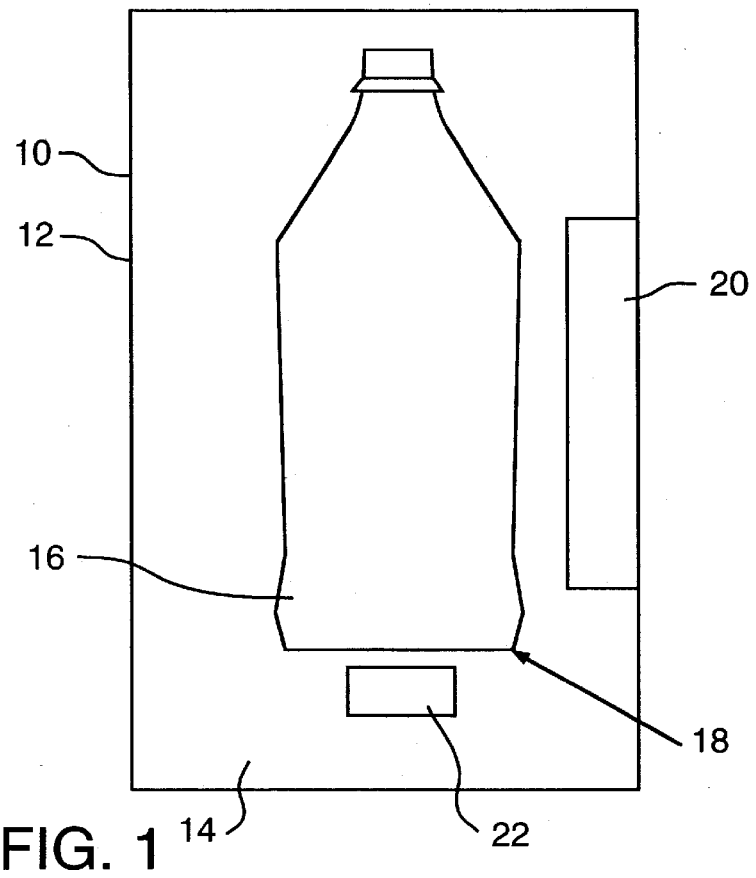
FIG. 1 is front view of a front panel of a vending machine.

FIG. 1 shows a vending machine 10 having a housing 12 and a front panel 14 formed with decorative graphics 16. The front panel is preferably formed with a three dimensional profile. The front panel as shown is formed with a three dimensional soda bottle 18 having a generally convex profile. The front panel can be formed of molded plastic or the like and can be translucent or opaque. The bottle as shown is formed with a bottom, a body and a top which is shown generally open and is approximately 1.25 to 1.5 meters in height. The vending machine also has a panel for various vending controls 20, product dispensing equipment 22, for example for dispensing refrigerated soft drinks, and is coupled to an electrical supply (not shown), all which are well known. The soda bottle shown in FIG. 1 is illustrative only; a very large variety of decorative graphics are suitable for use with the invention.

Figure 2:
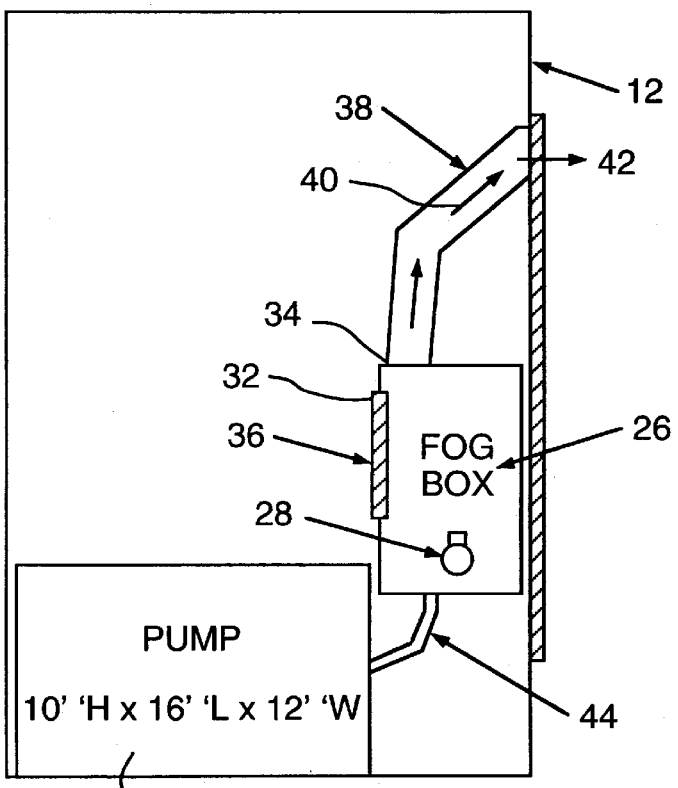
FIG. 2 is a side pictorial view of the vending machine showing the fog box and conduit installed behind the front panel of the vending machine.

FIG. 2 pictorially shows the misting or fogging means positioned within the vending machine housing 12. A pump 24, having a low pressure inlet and a high pressure outlet (not shown), is positioned in the base of the vending machine housing and is coupled to a supply of coolant. Preferably, the coolant is tap water provided by a public utility at standard pressure, such as 45 psi via conventional plumbing fittings (not shown). The pump is coupled to an electrical supply (not shown). The water supply is coupled to the pump inlet via conduits or the like (not shown), the pump preferably being operable to provide a supply of coolant under pressure at the high pressure outlet.

The pump high pressure outlet is coupled to a fog box 26 mounted within the vending machine housing. The fog box has at least one nozzle 28 operable to produce a fine mist of coolant or fog; the nozzle is coupled to the pump high pressure outlet via suitable high pressure conduits 30 (see FIG. 3). The fog box has an air inlet 32, an air outlet 34 and a fan 36 for generating an air flow. The fog box outlet is coupled to an inlet of at least one conduit 38 for carrying the flow air as shown by arrows 40. The conduit has an outlet 42 which is coupled to the vending machine front panel and/or otherwise traverses the front panel and provides an opening through which the airflow and fog flows.

The pump preferably provides water at a pressure in the range of 800 to 1000 psi. The pump 24 and fan 36 preferably utilize standard AC power and/or can be coupled directly to the vending machine power supply. The pump 24 and fan 36 can be arranged for continuous operation or can be arranged for intermittent operation (i.e., controlled by a timer or the like for operation during daytime hours).

The fog box provides a discrete environment for generation of an extremely fine mist of atomized coolant, preferably having an average water droplet diameter of 5 microns. Generation of such fine mists or fogs also produces some liquid water due to condensation and the like. The fog box is also provided with a drain line 44 for returning any accumulated water to the pump.

Figure 3:
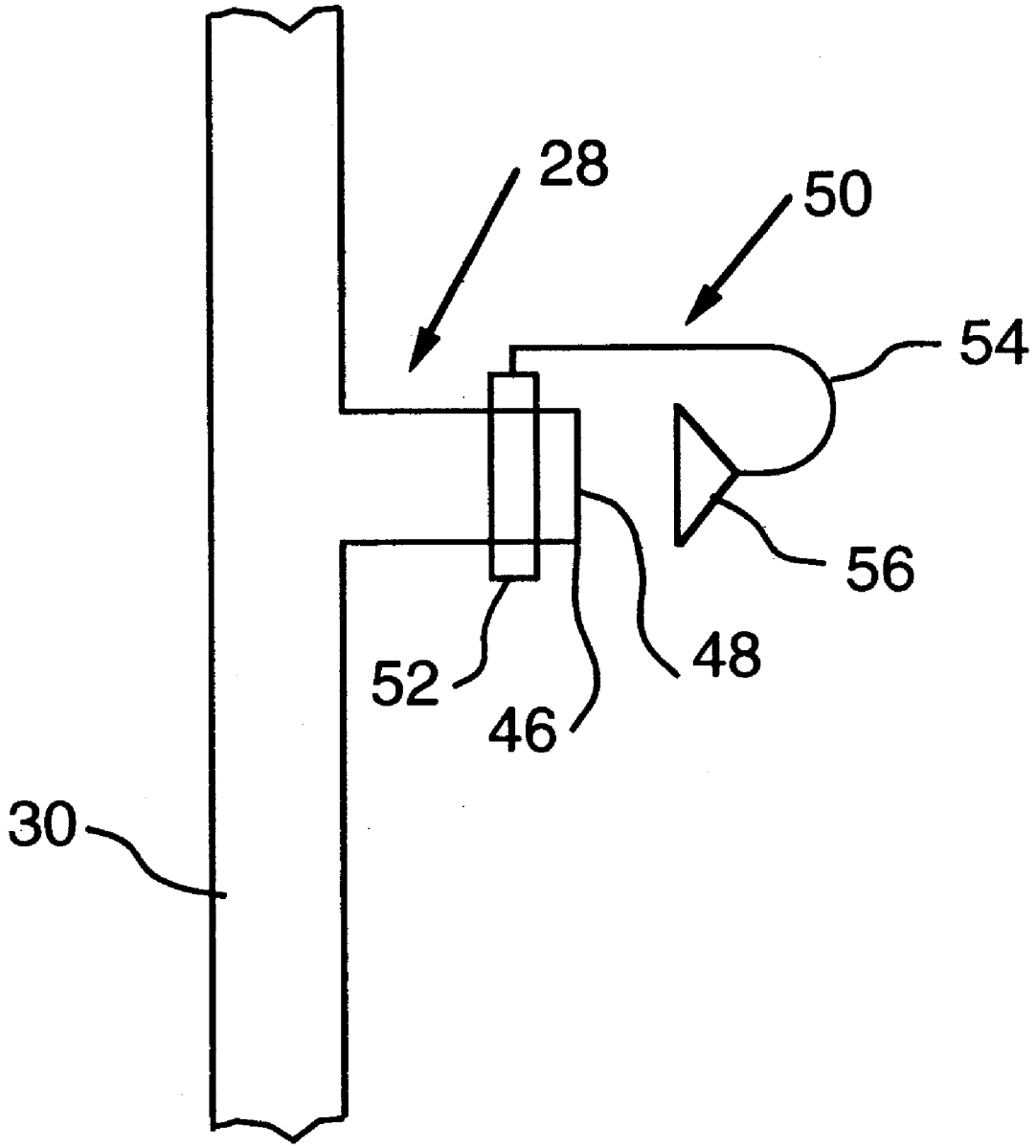
FIG. 3 is a pictorial view of nozzle used to produce atomized coolant in a fine mist or fog.

FIG. 3 shows the structure of a suitable nozzle 28 for producing extremely fine mist or fog. The nozzle comprises a standard nozzle tip 46 formed with a small aperture 48 and a plate assembly 50 positioned in front of the aperture via a collar 52 and support rod 54. High pressure water is delivered to the nozzle via a high pressure conduit. The nozzle has a tip formed with a small aperture approximately 0.008 inches (0.00315 cm) in diameter (not shown) as is conventionally known. Such nozzles are currently available for producing water droplets approximately 10 microns in diameter. The atomized water is discharged from the nozzle aperture and strikes the plate 56 located approximately 0.5 inches (1.25 cm) away from and directly in front of the aperture. The atomized water is further atomized (fractured) thereby yielding a fine mist or fog having an average water droplet diameter of 5 microns.

The fog is discharged through the conduit outlet 42 and flows from the front panel of the vending machine. Current research shows that the fog travels approximately 1.85 meters from the vending machine. The fog produced in accordance with the invention flash evaporates and is generally dry to the touch thereby allowing users the operate the vending machine without getting wet.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A fogging vending machine comprising:

a vending machine having a housing, a fogging means having at least one outlet for providing a fog consisting essentially of a mist of coolant, atomized, partially evaporated and entrained in an air flow, at least one conduit having an inlet coupled to the fogging means and an outlet coupled to the housing for directing the fog away from the housing.

2. The fogging vending machine of claim 1 wherein the fogging means comprises a fog box having an inlet and at least one outlet for providing the mist of coolant, a fan coupled to the fog box inlet for generating the air flow, a pump with a low pressure inlet coupled to a supply of water and a high pressure outlet, at least one nozzle coupled to the high pressure outlet, the at least one nozzle being located within the fog box for generation of the mist of coolant whereby the air flow generated by the fan causes the discharge of the fog from the fog box outlet.

3. The fogging vending machine of claim 1 wherein the coolant is water.

4. The fogging vending machine of claim 1 wherein the fogging means is coupled to the housing.

5. The fogging vending machine of claim 1 wherein the fogging means is located within the housing.

6. The fogging vending machine of claim 2 wherein the nozzle has a tip with an aperture and a plate assembly for producing a fine mist having an average droplet diameter of approximately 5 microns.

7. The fogging vending machine of claim 2 wherein the nozzle aperture is approximately 0.00315 cm in diameter.

8. The fogging vending machine of claim 2 comprising a collar and a support rod coupled to the plate for positioning the plate in front of the aperture.

9. The fogging vending machine of claim 2 wherein the pump provides coolant pressurized in the range of 800 to 100 psi at the high pressure outlet.

10. The fogging vending machine of claim 2 wherein the pump and fan are operable continuously.

11. The fogging vending machine of claim 2 wherein the pump and fan are operable intermittently.

12. The fogging vending machine of claim 2 comprising at least one timer coupled to the fan and pump so that the pump and fan are intermittently operable.

13. The fogging vending machine of claim 2 comprising a drain for collecting coolant which drips from the nozzle.

14. The fogging vending machine of claim 13 wherein the drain is coupled to the pump for returning accumulated coolant to the pump in a circulating flow.

15. The fogging vending machine of claim 1 herein the vending machine has a front panel and the conduit is coupled to the front panel.

16. The fogging vending machine of claim 15 wherein the front panel has decorative graphics.

17. The fogging vending machine of claim 1 wherein the vending machine is operable to vend cold drinks.

* * * * *